US006537343B2

(12) United States Patent
Majagi et al.

(10) Patent No.: US 6,537,343 B2
(45) Date of Patent: Mar. 25, 2003

(54) CORROSION AND WEAR RESISTANT CEMENTED CARBIDE

(75) Inventors: Shivanand Majagi, Rogers, AR (US); Debangshu Banerjee, Fayetteville, AR (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/921,808

(22) Filed: Aug. 3, 2001

(65) Prior Publication Data

US 2003/0024350 A1 Feb. 6, 2003

(51) Int. Cl.[7] ..... C22C 29/06
(52) U.S. Cl. ..... 75/240
(58) Field of Search ..... 75/240

(56) References Cited

U.S. PATENT DOCUMENTS

| | | | | |
|---|---|---|---|---|
| 2,753,621 | A | * 7/1956 | Wellborn | |
| 3,532,492 | A | * 10/1970 | Powell | |
| 3,552,937 | A | * 1/1971 | Mito et al. | |
| 4,173,457 | A | * 11/1979 | Smith | |
| 5,778,301 | A | 7/1998 | Hong | 419/15 |
| 5,833,838 | A | 11/1998 | Heyse et al. | 208/48 R |
| 6,258,256 | B1 | 7/2001 | Heyse et al. | 208/48 R |

FOREIGN PATENT DOCUMENTS

GB 1202844 8/1970

OTHER PUBLICATIONS

"Kennametal Specialty Carbide Products" Brochure, Kennametal Inc., A93–35– (10) A5, 1993, 15 pages.

ASM Handbook, vol. 3, Alloy Phase Diagrams, 1992, ASM International, Materials Park, Ohio, 3 pages.

Metals Handbook Ninth Edition, vol. 13, Corrosion, 15 pages.

Brookes, Kenneth J A, CEng FIm FJI, World Directory and Handbook of Hardmetals, Fourth Edition, International Carbide Data, 1987, 4 pages.

Brookes, Kenneth J A, CEng FIM FCIJ, World Directory and Handbook of Hardmetals and Hard Materials Fifth Edition, International Carbide Data, 1992, 5 pages.

Carmet PCC Structurals, Inc., Grade Conversion Properties, 1999, 3 pages, at www.carmetcarbide.com/grade_conversion. htm.

Carmet PCC Structurals, Inc., Carmet Quality Products, 3 pages, at www. carmetcarbide.com/products.htm.

Schwarzkopf, Dr. Paul, and Kieffer, Dr. Richard, "Cemented Carbides," The MacMillan Company, 1960, 6 pages.

General Carbide Corporation "Get Your Nickel's Worth," "A Guide to Carbide Grade Selection," 4 pages, at www.generalcarbide.com/products/nickel_performs.

Carmet PCC Structurals, Inc., Material Property Data Grade CA–815,) 1 page.

Kny, E. and Schmid, L. (Metallwerk Plansee Gesellschaft, Reutte, Austria, New Hardmetal Alloys with Improved Erosion and Corrosion Resistance, R&HM Sep. 1987, 4 pages.

* cited by examiner

*Primary Examiner*—Ngoclan Mai
(74) *Attorney, Agent, or Firm*—Kevin P. Weldon

(57) ABSTRACT

A product having a chromium carbide based cemented carbide composition with a nickel and/or chromium based binder is disclosed. It possesses excellent corrosion resistance in combination with good strength and hardness/abrasion resistance. The average chromium carbide grain size is less than 10 $\mu$m.

31 Claims, 3 Drawing Sheets

CORROSION AND WEAR RESISTANT CEMENTED CARBIDE

BACKGROUND OF THE INVENTION

1. Field of the Invention

The present invention relates to chromium carbide-cemented carbide compositions, articles made therefrom and their processing.

2. Background

A chromium carbide ($Cr_3C_2$) nickel based (i.e., greater than 50 w/o $Cr_3C_2$) grade of cemented carbide has been made for many years. However, it has been difficult to control the grain growth of chromium carbide during liquid phase sintering. The chromium carbide grain size of this material is coarse. These coarse grains result in a material having reduced strength, toughness, hardness/abrasion resistance which greatly limits its commercial application. An example of a prior art commercial grade of chromium carbide—nickel is a composition reportedly having 85 w/o chromium carbide 15 w/o nickel, Rockwell A hardness of 88.5, density of 7.00 g/cc, transverse rupture strength of 100 ksi (689 N/mm$^2$) and A04 porosity. A microstructure of this prior art material is shown in FIG. 1.

It would, therefore, be desirable to produce a chromium carbide based (i.e., at least 50 w/o $Cr_3C_2$) cemented carbide composition having a combination of high corrosion resistance with high strength, toughness and hardness/abrasion resistance.

SUMMARY OF THE INVENTION

In accordance with the present invention, an article of manufacture is provided having a chromium carbide based composition having a combination of excellent corrosion resistance and good wear resistance, strength and toughness.

In accordance with the present invention, the chromium carbide based composition has chromium carbide grains, having an average grain size of less than 10 $\mu$m disbursed in and cemented together by a nickel and/or chromium based binder.

Preferably, the average grain size of the chromium carbide grains are less than 8 $\mu$m and more preferably less than 5 $\mu$m.

Preferably, the chromium carbide based composition has a porosity rating of A02 or better.

Preferably, the chromium carbide composition has an average transverse rupture strength of at least 875 N/mm$^2$, more preferably at least 1000 N/mm$^2$, and most preferably at least 1075 N/mm$^2$.

A particularly preferred composition in accordance with the present invention has a nickel content of 13 to 17 weight percent and a chromium carbide content of 83 to 87 weight percent, with a chromium carbide average grain size of less than 8 $\mu$m, a porosity rating of A02 or better, a Rockwell A hardness of at least 89.5, and an average transverse rupture strength of at least 1075 N/mm$^2$.

These and other aspects of the invention will become more apparent upon consideration of the drawings, which are briefly described below, in conjunction with the Detailed Description of the Invention.

DETAILED DESCRIPTION OF THE INVENTION

Figure 1:
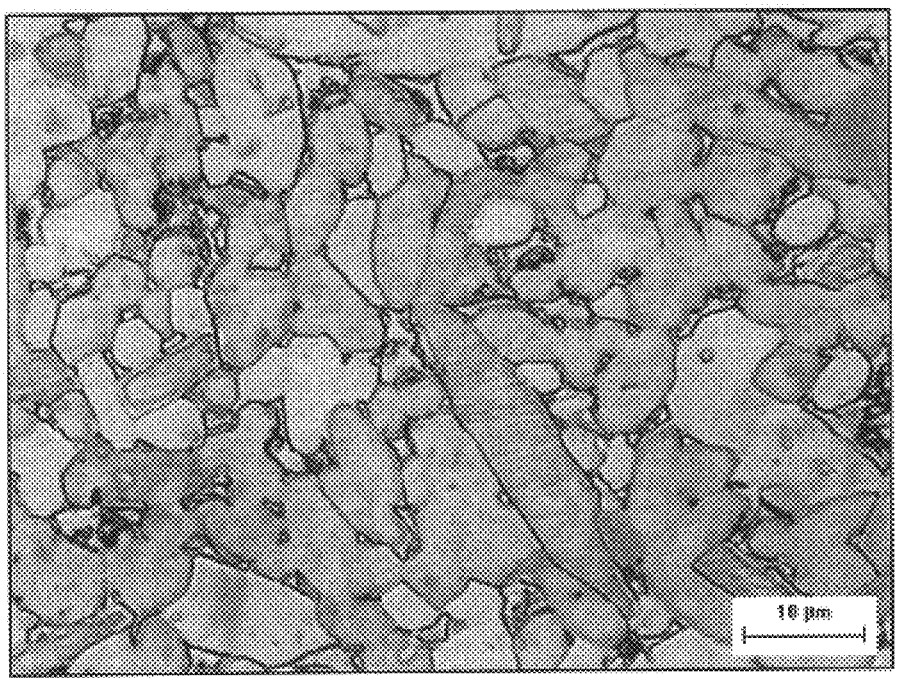
FIG. 1 is a photomicrograph of a prior art $Cr_3C_2$–15 weight percent nickel cemented carbide composition having coarse chromium carbide grains, not in accordance with the present invention.

In the present invention, articles are provided which are composed of a corrosion resistant chromium carbide based cemented carbide composition having improved toughness and hardness/abrasion resistance compared to the prior art. This combination of properties is achieved by strict control of the chromium carbide grain size in the composition. By chromium carbide based, it is intended that compositions according to the present invention contain greater than 50 weight percent chromium carbide. Preferably, the compositions according to the present invention contain at least 70, more preferably at least 85, and most preferably at least 90 weight percent chromium carbide.

The articles, according to the present invention, are made according to a powder metallurgy process in which powders are compacted and then densified to at least substantially fill density by sintering. Liquid phase or solid state sintering may be used, but the time and temperatures of sintering and any subsequent high temperature operations are controlled to assure that the chromium carbide average grain size in the final article is less than 10 $\mu$m. Preferably, the chromium carbide average grain size is less than 8 $\mu$m, more preferably less than 5 $\mu$m. As the grain size is reduced, the strength and hardness/abrasion resistance increase.

Preferably, sintering temperatures are held to temperatures below 1225° C. and more preferably 1200° C. or less. For example, sintering temperatures of 1200° C. and 1150° C. are specifically contemplated. For example, after vacuum or inert gas sintering, final densification may be achieved by hot isostatic pressing, at temperatures preferably below 1225° C., if needed to achieve a porosity rating of A02 or better to maximize the transverse rupture strength.

The average transverse rupture strength of the present invention should be at least 875 N/mm$^2$, and more preferably at least 1000 N/mm$^2$, and most preferably at least 1075 N/mm$^2$.

Alternatively, the composition according to the present invention may be densified by using the ROC (Rapid Omnidirectional Compaction) process described in U.S. Pat. Nos. 4,744,943; 4,945,073; and 5,563,107. Preferably, to assure the finest grain size and a porosity of A02 or better, ROC densification is also done below 1225° C.

The chromium carbide grains are cemented together by a binder that is either nickel, a nickel alloy, or a chromium alloy. It is specifically contemplated that nickel and nickel chromium alloys are preferred. It is to be understood that during sintering a pure nickel binder may alloy with chromium and carbon from the chromium carbide grains to form a nickel chromium-carbon alloy binder in the final article.

The binder is added to the chromium carbide particles as a powder and blended and milled together therewith. Alternatively, or in addition to starting with a binder powder, such as nickel, the chromium carbide particles may be precoated with nickel, chromium or a nickel-chromium alloy (e.g., 50 w/o Ni–50 w/o Cr alloy coating).

The concentration of the binder is preferably about 4 to 30 weight percent of the composition, and more preferably 4 to 20, and most preferably 4 to 10 weight percent of the composition for high hardness/abrasion resistance, or alternatively 13 to 17 weight percent for a good combination of strength and hardness/abrasion resistance.

Whereas, TiC and/or WC have been added to prior art compositions to control grain size, and increase abrasion resistance, in the present invention, preferably, TiC and WC are not added in order to avoid any reduction in corrosion resistance. If they are present, they are present at impurity levels only, i.e., less than 1.5, and preferably less than 1.0 weight percent of each of Ti and W.

In addition to the grain size and porosity properties of this invention previously discussed, the present invention preferably has: a Rockwell A hardness of at least 89, preferably at least 89.5, and more preferably 89.5 to 94 and most preferably 89.5 to 92.5; a Palmqvist fracture toughness of at least 95 Kg/mm; and a $K_{1c}$ fracture toughness of at least 10 MPa.m ½, preferably 12 to 18 MPa.m ½.

The significant advantages of the present invention are further indicated by the following examples which are intended to be purely illustrative of the present invention.

EXAMPLE I.

85 grams of $Cr_3C_2$ powder from Tokyo Tungsten having an average particle size of about 1 μm and 15 grams of nickel powder from International Nickel Company Canada, distributed by Novomet, having an average particle size of about 3 μm were formed into a 100 μm batch in a laboratory size ball mill containing heptane, wax and cobalt cemented tungsten carbide balls by milling for six hours. The milled powder was then dried and sample compacts were then formed by uniaxial pill pressing at room temperature using a mechanical press. The sample compacts were then densified, using one of the two methods described below:

Example IA.

Figure 2:
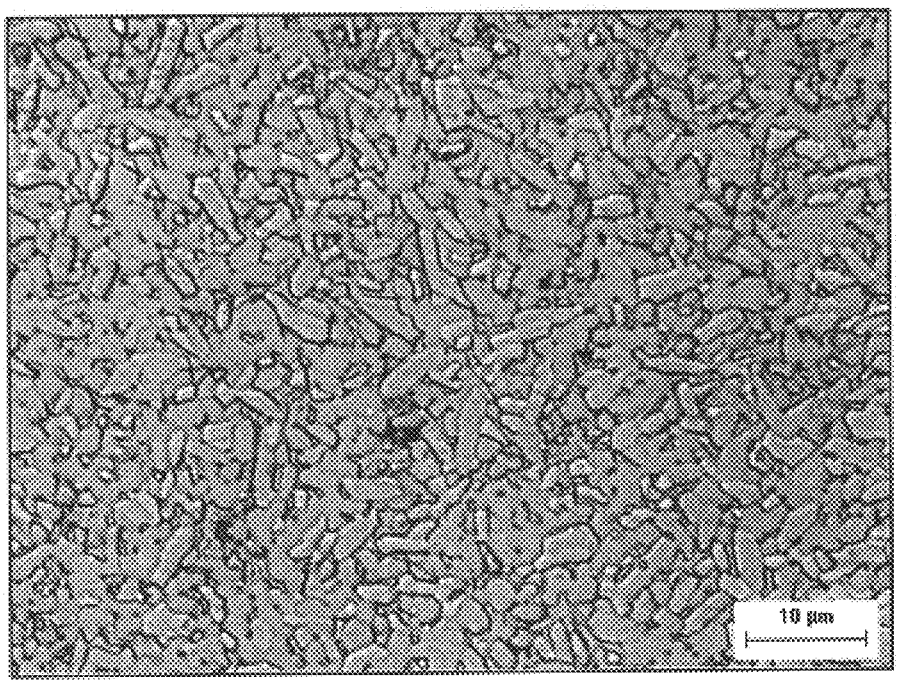
FIG. 2 is a photomicrograph of an embodiment of a $Cr_3C_2$–15 weight percent nickel cemented carbide composition having fine chromium carbide grains in accordance with the present invention.

These compacts were presintered at 900° C. for sixty minutes in a vacuum. The presintered compacts were then encapsulated and ROCed at 1200° C., using a pressure of about 120,000 p.s.i. The resulting microstructure is shown in FIG. 2.

Example IB.

These compacts were sintered at 1200° C. for 60 minutes under a 300 μm Hg vacuum. The resulting microstructure is shown in FIG. 3.

Properties of the Example IA and IB materials according to the present invention were as follows: density 6.93 g/cc; average Rockwell A hardness 89.8; average Palmqvist fracture toughness 100 kg/mm$^2$; $K_{1C}$~10.2 MPa.m ½ (estimated from Palmqvist value); average transverse rupture strength of 1080 N/mm$^2$ (3 point test in accordance with ASTM Designation B406-96); and A02 porosity (per ASTM Designation B276-91 [reapproved 1996] entitled "Standard Test Method for Apparent Porosity in Cemented Carbides"). The IA material also had excellent resistance to corrosion in a dilute (pH=1) HCl solution. It is expected that the IB material would have similar corrosion resistance.

Figure 3:
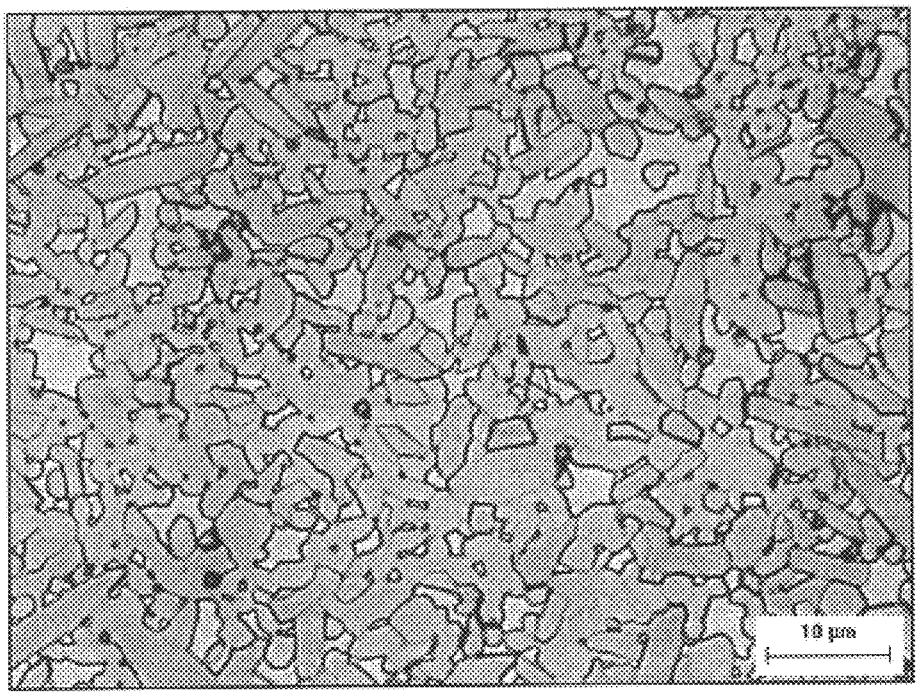
FIG. 3 is a photomicrograph of a second embodiment of a $Cr_3C_2$–15 weight percent nickel cemented carbide composition having fine chromium carbide grains in accordance with the present invention.

Comparing FIGS. 2 and 3, it can be seen that while both materials had a fine and substantially uniform chromium carbide grain size, the ROCed material in FIG. 2 had a finer grain size and a more uniform distribution of binder phase.

Example II.

In accordance with the procedure described in conjunction with Example IA, a 94 weight percent chromium carbide –6 weight percent nickel composition was fabricated. Its properties were as follows: density 6.77 g/cc; average Rockwell A hardness 92; porosity between A02–A04.

Figure 4:
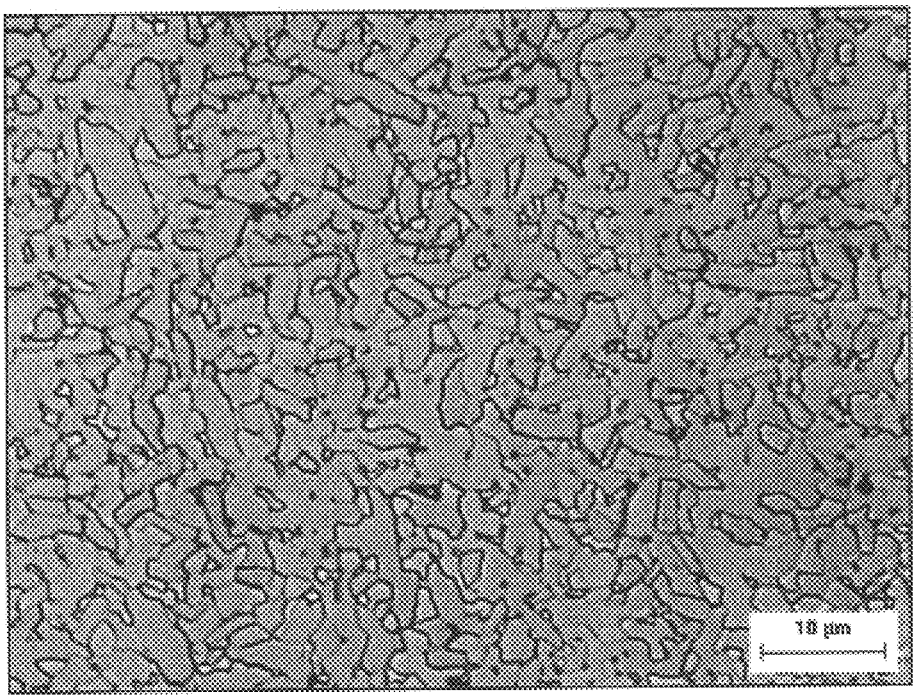
FIG. 4 is a photomicrograph of an embodiment of a $Cr_3C_2$–6 weight percent nickel cemented carbide composition having fine chromium carbide grains in accordance with the present invention.

Its microstructure is shown in FIG. 4.

Examples III and IV.

Figure 5:
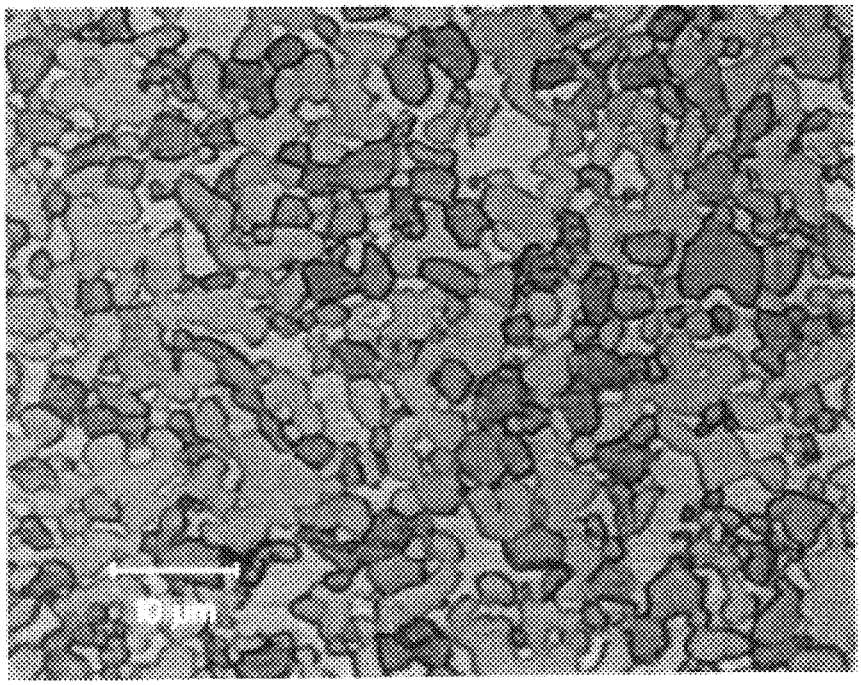
FIG. 5 is a photomicrograph of an embodiment of a $Cr_3C_2$–25 weight percent nickel cemented carbide composition having fine chromium carbide grains in accordance with the present invention.
Figure 6:
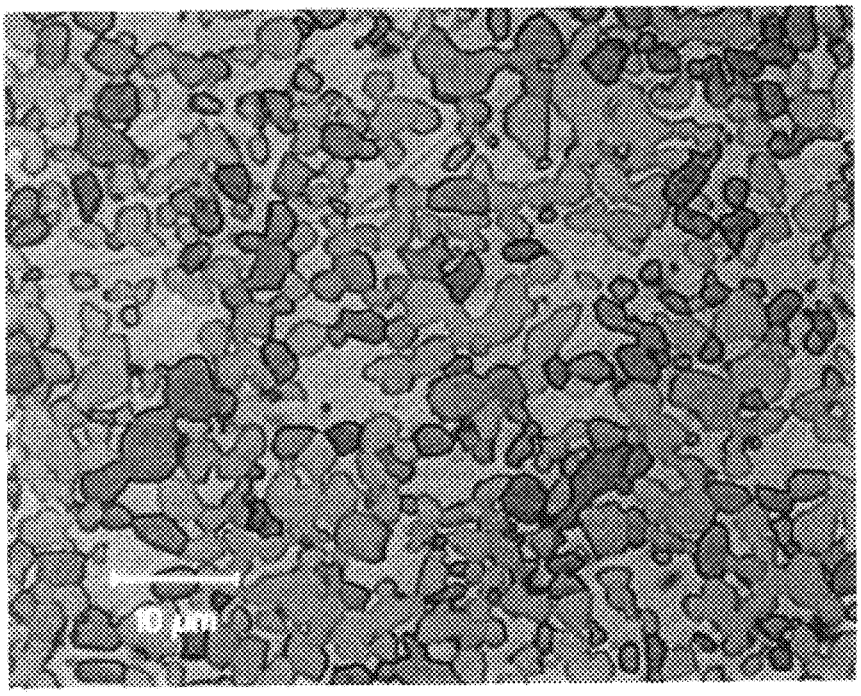
FIG. 6 is a photomicrograph of an embodiment of a $Cr_3C_2$–35 weight percent nickel cemented carbide composition having fine chromium carbide grains in accordance with the present invention.

In accordance with the Example IA processing procedure, a 75 w/o $Cr_3C_2$–25 w/o nickel composition and a 65 w/o $Cr_3C_2$–35 w/o nickel composition were fabricated. However, in these cases, the presintered compacts were ROCed at 1150° C. The 75 w/o $Cr_3C_2$ composition had an average Rockwell A hardness of 86.1, a density of 7.13 and a porosity rating of A02. The 65 w/o $Cr_3C_2$ composition had an average Rockwell A hardness of 81.3, a density of 7.28, and a porosity of A02. As can be seen in FIGS. 5 and 6, both the 75 w/o $Cr_2C_3$ and 65 w/o $Cr_2C_3$ compositions have an average chromium carbide grain size of 5 μm or less, and that the shape of these grains are substantially spherical. The inventors expect that applying this lower processing temperature (i.e., 1150° C.) to higher chromium carbide compositions in accordance with the present invention will result in similar microstructures.

The articles of manufacture which may advantageously use the present composition include, for example, seal rings, valves, pumps, centrifuges, nozzles, mills, plungers, pelletizer knives and their component parts, including any industrial application such as in the chemical or petrochemical, pharmaceutical, textile, and food processing industries where corrosive solids, liquids and/or gases are handled and abrasion resistance is an issue.

All patents and other documents referred to herein are hereby incorporated by reference.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. An article of manufacture having a chromium carbide based composition comprising;

a binder selected from the group consisting of nickel, nickel alloys, and chromium alloys; and chromium carbide grains dispersed in and cemented together by the binder;

wherein said chromium carbide grains having an average grain size of less than 10 μm and said chromium carbide based composition is free from tungsten carbide except for impurities.

2. The article of manufacture according to claim 1 wherein the average grain size is less than 8 μm.

3. The article of manufacture according to claim 1 wherein the binder is a nickel chromium alloy.

4. The article of manufacture according to claim 1 wherein the binder forms 4 to 30 weight percent of the chromium carbide based composition.

5. An article of manufacture having a chromium carbide based composition comprising:

4–30 weight percent of nickel;

chromium carbide grains having an average grain size of less than 8 $\mu$m;

wherein the chromium carbide grains are cemented together by said nickel;

the chromium carbide based composition having a porosity rating of A02 or better.

6. The article according to claim 5 wherein the average grain size is less than 5 $\mu$m.

7. The article according to claim 5 wherein said composition has a Rockwell A hardness of at least 89.

8. The article according to claim 5 wherein said composition has a Rockwell A hardness of at least 89.5.

9. The article according to claim 5 wherein said composition has a Palmqvist fracture toughness of at least 95 kg/nun.

10. The article according to claim 8 wherein said composition has a Palmqvist fracture toughness of at least 95 kg/mm.

11. The article according to claim 5 wherein the composition has a hardness of 89.5 to 94 Rockwell A.

12. The article according to claim 5 wherein the composition has a $K_{Ic}$ fracture toughness of 12 to 18 $MP_{am}$½.

13. The article according to claim 8 wherein the chromium carbide grains have an average grain size of less than 5 $\mu$m.

14. The article according to claim 5 wherein the chromium carbide grains are substantially spherical in shape.

15. The article according to claim 13 wherein the chromium carbide grains are substantially spherical in shape.

16. The article according to claim 5 wherein nickel forms 4 to 20 weight percent of the composition.

17. The article according to claim 11 wherein nickel forms 4 to 10 weight percent of the composition.

18. The article according to claim 5 wherein the composition has an average transverse rupture strength of at least 875 N/mm$^2$.

19. The article according to claim 5 wherein the composition has an average transverse rupture strength of at least 1000 N/mm$^2$.

20. The article according to claim 5 wherein the composition has an average transverse rupture strength of at least 1075 kg/mm$^2$.

21. An article of manufacture having a chromium carbide based composition comprising:

13 to 17 weight percent nickel;

83 to 87 weight percent chromium carbide;

chromium carbide grains having an average grain size of less than 8 $\mu$m;

wherein the chromium carbide grains are cemented together by said nickel;

the chromium carbide based composition having a porosity of A02 or better, a Rockwell A hardness of at least 89.5, and an average transverse rupture strength of at least 1075 N/mm$^2$.

22. The article according to claim 1 wherein said chromium carbide based composition is free from titanium carbide except for impurities.

23. The article according to claim 1 wherein the impurity level of tungsten carbide is at most 1.5% weight percent of the composition.

24. The article according to claim 1 wherein the impurity level of tungsten carbide is at most 1.0% weight percent of the composition.

25. An article of manufacture having a chromium based composition consisting essentially of:

a binder selected from the group consisting of nickel, nickel alloys, and chromium alloys; and chromium carbide grains dispersed in and cemented together by the binder;

wherein said chromium carbide grains having an average grain size of less than 10 $\mu$m.

26. A sintered alloy composition consisting essentially of a binder selected from the group consisting of nickel, nickel alloys, and chromium alloys; and chromium carbide grains dispersed in and cemented together by the binder;

wherein said chromium carbide grains having an average grain size of less than 10 $\mu$m.

27. A chromium carbide based composition comprising:

a binder selected from the group consisting of nicken, nickel alloys, and chromium alloys; and chromium carbide grains are dispersed in and cemented together by the binder;

wherein said chromium carbide grains having an average grain size of less than 10 $\mu$m and said chromium carbide based composition is free from tungsten carbide except for impurities.

28. An article of manufacture having a chromium carbide based composition comprising:

a nickel chromium alloy binder; and chromium carbide grains dispersed in and cemented together by the binder;

wherein said chromium carbide grains having an average grain size of less than 10 $\mu$m.

29. An article of manufacture having a chromium carbide based composition comprising:

4–30 weight percent of nickel;

substantially spherical chromium carbide grains having an average grain size of less than 8 $\mu$m;

wherein the chromium carbide grains are cemented together by said nickel.

30. An article of manufacture having a chromium carbide based composition comprising:

4–30 weight percent of nickel;

substantially spherical chromium carbide grains having an average grain size of less than 5 $\mu$m;

wherein the chromium carbide grains are cemented together by said nickel.

31. An article of manufacture having a chromium carbide based composition comprising:

4–10 weight percent of nickel;

chromium carbide grains having an average grain size of less than 8 $\mu$m;

wherein the chromium carbide grains are cemented together by said nickel.

* * * * *